US010035356B2

(12) United States Patent
Encrenaz et al.

(10) Patent No.: US 10,035,356 B2
(45) Date of Patent: Jul. 31, 2018

(54) INKJET PRINTER WITH PRIMARY AND SECONDARY INK TANKS

(71) Applicant: HEWLETT-PACKARD DEVELOPMENT COMPANY, L.P., Houston, TX (US)

(72) Inventors: Michel Georges Encrenaz, Rubi (ES); Joaquim Bea, San Cugat del Valles (ES); Emilio Angulo Navarro, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/515,298

(22) PCT Filed: Oct. 31, 2014

(86) PCT No.: PCT/EP2014/073388
§ 371 (c)(1),
(2) Date: Mar. 29, 2017

(87) PCT Pub. No.: WO2016/066208
PCT Pub. Date: May 6, 2016

(65) Prior Publication Data

US 2017/0232756 A1 Aug. 17, 2017

(51) Int. Cl.
*B41J 2/195* (2006.01)
*B41J 2/175* (2006.01)

(52) U.S. Cl.
CPC ..... *B41J 2/17566* (2013.01); *B41J 2/17546* (2013.01); *B41J 2/17596* (2013.01)

(58) Field of Classification Search
CPC .... B41J 2/17566; B41J 2/175; B41J 2/17513; B41J 2/17596; B41J 2/17546
USPC ..... 347/5–7, 84–86
See application file for complete search history.

(56) References Cited

U.S. PATENT DOCUMENTS

| | | | | |
|---|---|---|---|---|
| 5,367,328 | A | 11/1994 | Erickson | |
| 8,366,257 | B2 * | 2/2013 | Sasaki | B41J 2/17509 347/7 |
| 8,371,682 | B1 * | 2/2013 | Del Raso | B41J 2/17596 347/84 |
| 2003/0128256 | A1 | 7/2003 | Oda et al. | |
| 2009/0295881 | A1 | 12/2009 | Tasaka et al. | |
| 2010/0220127 | A1 | 9/2010 | Levy | |
| 2011/0228020 | A1 | 9/2011 | Nishimori | |
| 2013/0321501 | A1 | 12/2013 | Igarashi | |
| 2014/0104333 | A1 | 4/2014 | Gunnell | |

FOREIGN PATENT DOCUMENTS

| | | |
|---|---|---|
| CN | 2006205554 | 8/2006 |
| CN | 1982068 | 6/2007 |
| CN | 201109238 | 9/2008 |
| CN | 101590736 | 12/2009 |

(Continued)

*Primary Examiner* — An Do
(74) *Attorney, Agent, or Firm* — HP Inc. Patent Department

(57) ABSTRACT

The present disclosure relates to an inkjet printer 30 including a carriage unit to which a printhead (PT) is coupled, a primary ink tank (T1) and a secondary ink tank (T2) to store ink, and a controller (CT2) to control a pump (PM) so as to cause the secondary ink tank (T2) to supply the primary ink tank (T1) with ink.

15 Claims, 5 Drawing Sheets

(56) References Cited

FOREIGN PATENT DOCUMENTS

| | | |
|---|---|---|
| CN | 101638006 | 2/2010 |
| CN | 101642985 | 2/2010 |
| CN | 101817263 | 9/2010 |
| CN | 201712257 | 1/2011 |
| CN | 102101387 | 6/2011 |
| CN | 102149545 | 8/2011 |
| EP | 2127886 | 12/2009 |
| JP | 2011235507 | 11/2011 |
| WO | WO9742035 | 11/1997 |

* cited by examiner

INKJET PRINTER WITH PRIMARY AND SECONDARY INK TANKS

BACKGROUND

Thermal inkjet hardcopy devices such as printers, large format plotters/printers, facsimile machines and copiers have gained wide acceptance. Inkjet printers and the like produce high quality print at a high speed because only ink strikes the paper.

An inkjet printer forms a printed image by printing a pattern of individual dots at particular locations of an array defined for the print medium.

DETAILED DESCRIPTION

Figure 1:
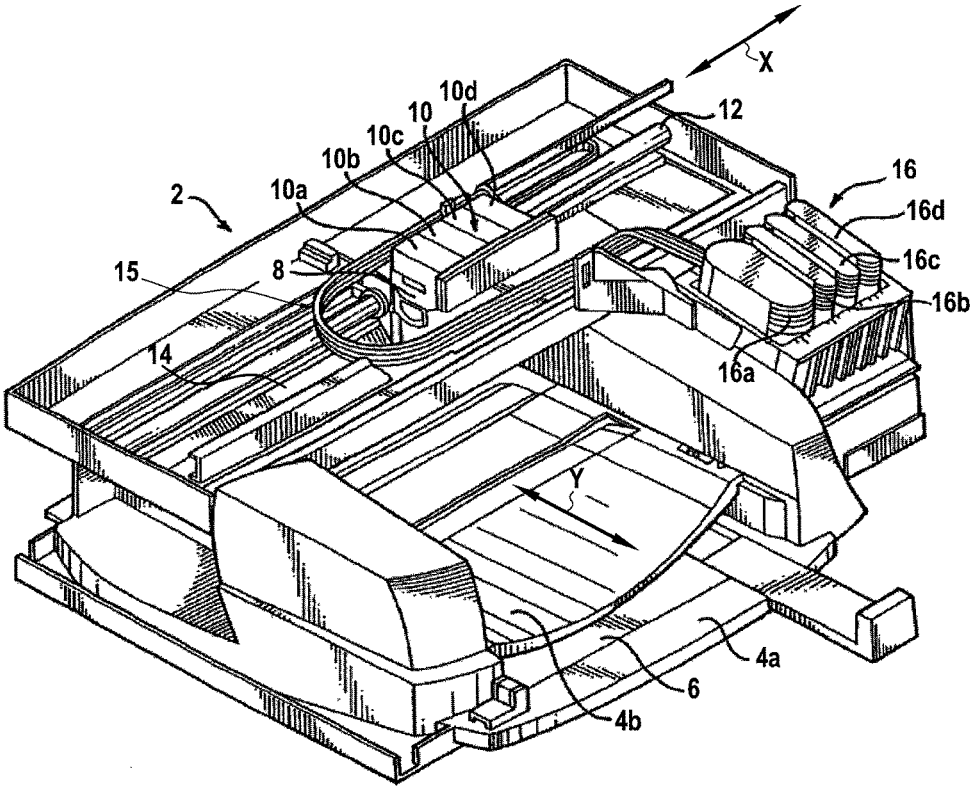
FIG. 1 shows the arrangement of an inkjet printer.

While the present disclosure is susceptible of examples in many different forms, there are shown in the drawing and will be described herein in detail specific examples thereto with the understanding that the present disclosure is to be considered as an exemplification of the principles of the disclosure and is not intended to limit the disclosure to the specific examples illustrated.

Numerous details are set forth to provide an understanding of the examples described herein. The examples may be practiced without these details.

For simplicity and clarity of illustration, reference numerals may be repeated among the figures to indicate corresponding or analogous elements.

Inkjet printers print dots by ejecting small drops of ink onto the print medium and include a carriage that supports one or more printheads each having ink ejecting nozzles. The carriage can typically be moved so as to traverse over the surface of the print medium, although other variants wherein the carriage is static are also possible (e.g. in wide-page array printers). The nozzles in inkjet printers are controlled to eject drops of ink at appropriate time pursuant to command of a microcomputer or other controller, wherein the timing of the application of the ink drops is intended to correspond to the pattern of pixels of the image being printed.

The base colours are produced on the print medium by depositing a drop of the required colour onto a dot location, while secondary or shaded colours are formed by depositing multiple drops of different base colours onto the same or an adjacent dot location, with the overprinting of two or more base colours producing the secondary colours.

Inkjet printers are typically provided with one or more ink tanks for storing an appropriate ink (coloured, black, dissolved solvent etc.). Each ink tank is to feed a particular printhead with an appropriate ink for allowing printing on the print medium.

However, print ink is often considered to be too expensive by end consumers. Additionally, the ink delivery system, and more particularly, the arrangement of the ink tanks, is not always satisfactory in existing inkjet printers.

FIG. 1 illustrates an example of a inkjet printer 2 which generally includes a tray 4*a* for holding print media. Description of such a printer can be found for instance in document U.S. Pat. No. 6,547,354 B1.

When a printing operation is initiated, a print medium 6 from tray 4*a* is fed into printer 2 using a sheet feeder, and then brought around in a U direction to now travel in the opposite direction toward the tray 4*b*. A carriage unit 8 supports and carries a set of removable mounted print cartridges 10*a* to 10*d* (collectively referred to as 10), each including a printhead capable of printing on the print medium 6.

The carriage unit 8 is supported in the present case by a slide rod 12 that permits the carriage unit to move along a traverse direction x under the driving force of a carriage mechanism. The print medium 6 can be stopped in a print zone 14 and the scanning carriage 8 is scanned across the print medium 6 for printing a swath of ink thereon. After a single scan or multiples scans, the print medium 6 is then incrementally shifted using a stepper motor and feed rollers to a next position within the print zone 14 for printing a next swath of ink.

Although the carriage unit 8 is a moving carriage unit in the present example, it should be understood that the present disclosure encompasses other examples wherein the carriage unit supporting the printheads is static. This is for instance the case for page-wide array printers with no or limited movement of the printheads across the print medium along the traverse direction x.

The inkjet printer 2 includes an ink delivery system for providing ink to the print cartridges 10 and ultimately to ink ejection chambers in the printheads from an off-axis ink supply station 16 containing replaceable ink supply cartridges 16*a* to 16*d*.

For colour printers, there will typically be a separate ink supply cartridge for black ink, yellow ink, magenta ink, and cyan ink. Four supply lines 15 are provided to carry ink from the four replaceable ink supply cartridges 16 to the print cartridges 10.

To carry out print jobs in good conditions, it is thus necessary that each tank 16 of the inkjet printer 2 is filled with a sufficient level of ink.

A problem resides in the fact that print ink for use in inkjet printers is often considered to be expensive for the end consumers.

Additionally, a problem generally arises in inkjet printers due to the fact that the capacity of ink tanks are often limited, thereby imposing the burden on users to monitor the ink level in each ink tank and, when appropriate, to replace the ink tanks running out of ink with new ink tanks (or refill the ink tanks). It is often not possible to provide an inkjet printer, even of a large format, with substantial supplies of ink.

Size-limited ink tanks prevent long unattended printing and have a negative impact on ink price.

Further, it is generally not possible to provide inkjet printers with additional ink while a print operation is under progress, thereby causing more inconvenience to a user who must wait for the end of a print operation before attending to the ink tanks.

The present disclosure provides an inkjet printer which includes a primary ink tank to store ink and a secondary (or auxiliary) ink tank to supply the primary ink tank with ink when necessary. Typically, the secondary ink tank allows advantageously to feed the primary tank with ink when the level of ink in the primary tank becomes insufficient (e.g. below a given level of ink).

The present disclosure also provides a method carried out by an inkjet printer of the present disclosure. Various examples of the present disclosure, including inkjet printers and methods of using such printers, will be described below by referring to several examples.

Regarding the examples of methods of using a printer described below, not all of the actions are required in all of the examples.

In the various examples contemplated below, the inkjet printer of the present disclosure includes at least one primary ink tank and at least one secondary ink tank, each of these tanks (or reservoirs) being arranged to store ink. Ink in the context of the present disclosure can be any kind of ink or print fluid which may be used for the purpose of printing.

Figure 2:
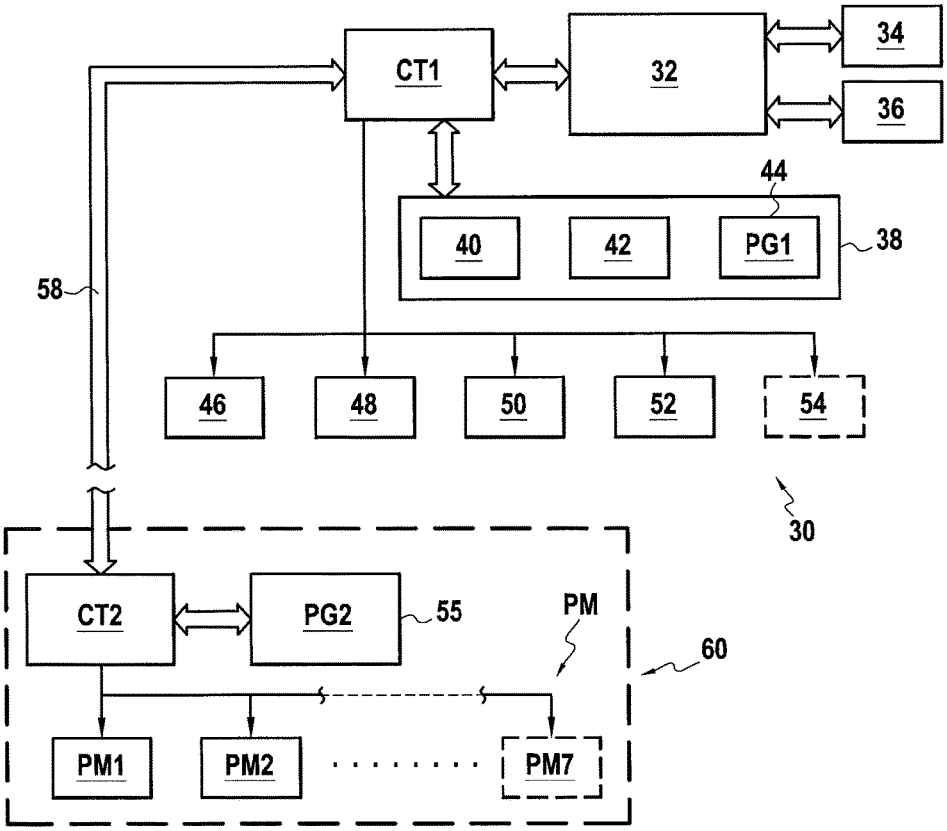
FIGS. 2 and 3 are diagrams showing in a schematic manner the arrangement of an inkjet printer according to an example of the present disclosure.
Figure 3:
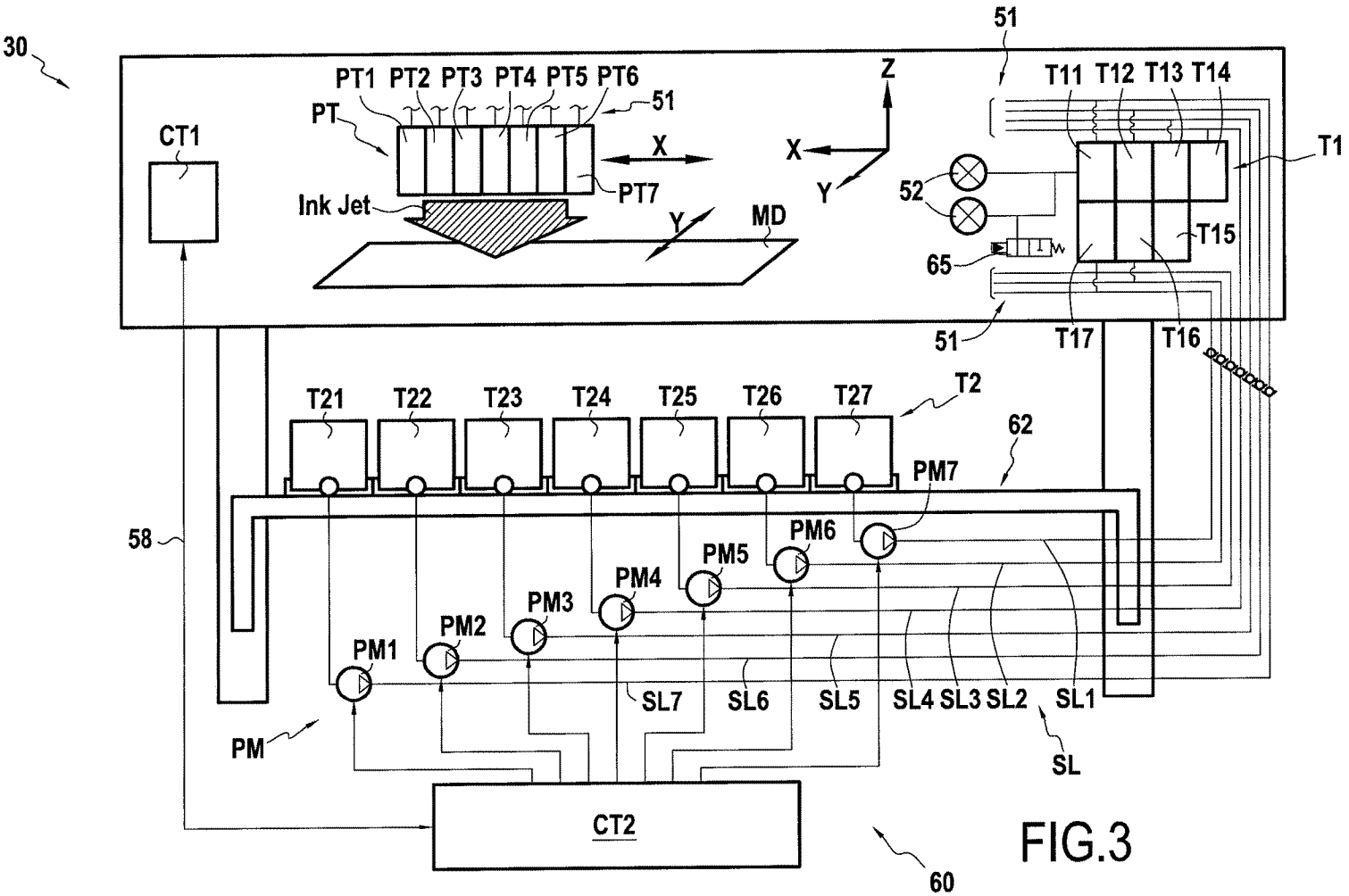

In a particular example of the present disclosure, an inkjet printer 10 is now considered in some detail in reference with FIGS. 2 and 3.

In an example, the inkjet printer 10 generally includes a controller CT1 (e.g. a microprocessor) that can communicate with an external computer system 34 by using an interface unit 32, when said computer system 34 is coupled with the printer 10.

The interface unit 32 may for instance facilitate the transferring of data and command signals to the controller CT1 for printing purposes. The interface unit 32 may also enable the inkjet printer 30 to be electrically coupled to an input device 36 for the purpose of downloading print image information to be printed on a print medium MD. Input device 28 can for instance be any type of peripheral device that can be coupled directly to the printer 30.

In order to store data, the printer 30 further includes a memory unit 38. The memory unit 38 may be divided into a plurality of storage areas that facilitate printer operations.

In the present example, the memory unit 38 includes a data storage unit 40, a storage unit 42 for driver routines, and a control storage unit 44 that stores machine readable instructions that facilitate the control implementation of the various components of the printer 30.

The data storage unit 40 may receive image data representative of images which may be printed by the inkjet printer 30 on a print medium MD.

In the present example, the control storage unit 44 stores a computer program PG1 according to a particular example, said computer program PG1 including instructions for carrying out a method according to a particular example. The control storage unit 44 constitutes a recording medium according to a particular example, readable by the controller CT1.

The inkjet printer 30 includes one or several primary ink tanks for storing ink that can be supplied to a respective printhead, when such a printhead is coupled to the printer 30. Each primary ink tank may have any size, shape, volume and structural configuration that will be appropriate for the purpose of storing ink in the inkjet printer 30.

For illustrative purpose only, and as shown in FIG. 3, the inkjet printer 30 includes in the present example seven primary tanks T11 to T17 (collectively referred to as T1), each being connected to a respective printhead PT1 to PT7 (collectively referred to as PT). Other numbers of primary tanks and printheads, and arrangements thereof can of course be contemplated in the present disclosure.

In this particular example, the controller 22 is to cooperate with components of the inkjet printer 30, namely, a carriage unit 46 (wherein the carriage unit may be a moving or a static carriage unit), at least one pressure sensor 48, a medium feeding unit 50, and at least one primary pump 52.

In a particular example, the controller 22 is also operable to cooperate with a counting unit 54 included in the inkjet printer 30 and which will be described later.

The carriage unit 46 is so that one or a plurality of printheads may be coupled thereto. Preferably, each printhead can be removably coupled to the carriage unit 46. For instance, one or several printheads may be mounted or positioned on the carriage unit 46. As indicated earlier, it will now be considered the example where seven printheads PT1 to PT7 are coupled to the carriage unit 46. In operation, each printhead PT can be supplied with ink by a corresponding primary ink tank T1 via an appropriate ink delivery circuit 51.

As shown in FIG. 3, the carriage unit 46 is to move along a traverse (or scan) direction x in response to commands from the controller CT1. As already mentioned, other examples can be contemplated wherein the carriage unit is static.

In the present example, the inkjet printer 30 is an off-axis printer in the sense that the primary tanks T1 are all positioned off the carriage unit 46 in the printer 30. Positioning the primary ink tanks off the carriage unit is advantageous in that it enables to remove a primary tank (and replacing it if needed) while a printing operation is in progress. One may however consider examples of the present disclosure wherein at least one primary tank T1 is provided on the carriage unit 46.

Further, the inkjet printer 30 includes at least one pressure sensor 48 operable to sense a pressure level in the primary ink tanks PT. In the present example, a respective pressure sensor 48 is provided for sensing the pressure present in an ink chamber of each primary tank T1. Depending on the cases, the pressure sensor 48 may be at least partly internal or external to the corresponding printhead PT.

Levels of pressure detected by each sensor 48 for the corresponding primary tank T1 can be collected by the controller CT1. Based on these pressure levels, it is possible to determine ink level in the primary ink tanks T1. In a particular example, each pressure sensor 48 is to transmit to the controller CT1 information related to the pressure level detected for a particular primary ink tank T1.

The controller CT1 may retrieve these pressure levels in response to a request sent beforehand by controller CT1 to the sensor 48, or in an unsolicited manner (e.g. on a regular basis).

The medium feeding unit 50 is operable to move the print medium MD (upon which printing is to be carried out) along a printing-medium advance direction y (see FIG. 3). The medium feeding unit 50 may for instance include rollers, a driving motor, detection means and/or any other appropriate means (not shown) for the purpose of moving the print medium MD along the y direction to the desired position so as to allow printing by the printheads PT.

The controller CT1 is operable to control the medium feeding unit 50 so as to adjust the y position of the print medium MD along the printing-medium advance direction in order to cause printing at the appropriate locations on the print medium MD.

The inkjet printer 30 also includes at least one primary pump 52 (e.g. air pumps) with which the controller CT1 may cooperate. In the present example, inkjet printer 30 includes two primary pumps operable, upon command from controller CT1, to create a positive pressure in at least one particular primary ink tank T1. By applying an appropriate positive pressure within a primary ink tank T1, it is possible to supply the corresponding printhead with the desired amount of ink.

The present disclosure is not limited to the example of two primary pumps. As indicated earlier, one or more than two primary pumps 52 may be used in the present example. The number and specifications of the primary pumps will be adapted if necessary by the skilled person depending on the requirements.

In operation, the controller CT1 controls movements of the carriage unit 46 and of the print medium MD, and cause ink deposition by the printheads PT by means of the primary pumps 52. By combining the relative movements of the carriage unit 46 along the scan direction x with the relative movement of the print medium MD along the medium-advance direction y, each printhead PT can deposit one or more drops of ink at each individual one of the pixel locations of the print medium MD.

In the present example, an ink supply module 60 is coupled with the inkjet printer 30 so that a controller CT2 of the ink supply module 60 can cooperate with controller CT1 of the inkjet printer 30 via communication line 58. It will be understood that any appropriate method of communication (wireless etc.) can be contemplated to enable controllers CT1 and CT2 to cooperate with each other.

The communication line 58 may for instance allow controllers CT1 and CT2 to communicate with each other. The communication line 58 may also enable the inkjet printer 30 to be electrically coupled to the ink supply module 60.

In a particular example, the ink supply module 60 is an accessory that can be installed and uninstalled when desired, for instance at the back of the inkjet printer 30. This module 60 may for instance take the form of a rack 62 which can be positioned at floor level.

In order to store data, the ink supply module 60 also includes in this example a memory unit 55 including a computer program PG2 according to a particular example. The computer program PG2 includes instructions for carrying out a method according to a particular example. The memory unit 55 constitutes a recording medium according to a particular example, readable by the controller CT2.

More generally, computer programs PG1 and PG2 collectively include instructions to implement a method of using an inkjet printer according to a particular example. In the present example, the ink supply module 60 can be removed if necessary from the inkjet printer 30. The ink supply module of the present disclosure is advantageous in that it can be adapted to be coupled with various types of inkjet printer.

In a particular example, the ink supply module 60 can be at least partly included in the inkjet printer 30.

In a particular example, the controllers CT1 and CT2 form one and same controller which is to carry out the instructions of computer programs PG1 and PG2.

The ink supply module 60 also includes at least one secondary (or auxiliary) ink tank T2 for storing ink that can be supplied to a respective primary ink tank T1, when ink supply module 60 is coupled with the inkjet printer 30. Each secondary ink tank T2 may have any size, shape, volume and structural configuration that will be appropriate for the purpose of storing ink for later use in the inkjet printer 30.

For illustrative purpose only, the ink supply module 60 includes in the present example seven secondary tanks T21 to T27 (collectively referred to as T2), each being connected to a respective primary ink tank T11 to T17 by means of a respective supply line SL1 to SL7 (collectively referred to as SL). Other numbers of secondary tanks and supply lines, and arrangements thereof can of course be contemplated in the present disclosure.

In a particular example, each supply line SL (e.g. printer ink tube) ensure a fluidic connection between a secondary tank T2 and a corresponding primary tank T1. In a variant, a supply line SL may connect at least one secondary tank T2 to at least primary tank T1.

Further, the ink supply module 60 includes at least one primary pump PM operable to pump ink from at least one secondary ink tank T2 to at least one corresponding primary ink tank T1, in response to a command from the controller CT2.

In the present example, the ink supply module 60 includes seven secondary pumps PM1 to PM7 (collectively referred to as PM), each being provided on a respective supply line SL1 to SL7. Each secondary pump PM1 to PM7 is operable to pump ink from a respective secondary ink tank T21 to T27 so as to supply the respective primary ink tank T11 to T17 with ink via the supply line SL1 to SL7.

In the present example, each secondary pump PM is provided on the respective supply line SL connecting a secondary ink tank T2 to a respective primary ink tank T1.

The controller CT2 is operative to actuate each secondary pump PM provided on a supply line SL to cause a secondary ink tank T2 to feed the corresponding primary ink tank T1 with ink via the appropriate supply line SL.

Each secondary pump PM in the inkjet printer 30 is to pump ink by direct contact from a secondary ink tank T2 to a corresponding primary ink tank T1. Pumping by direct contact means that the secondary pump physically contacts the ink during the action of pumping.

Feeding of ink from a secondary to a primary ink tank is triggered by the controller CT2 when appropriate, that is, when replenishment of ink is desired in the primary ink tank of interest.

In the present example, each secondary pump PM is to maintain a positive pressure in the corresponding primary ink tank T1 during the action of feeding with ink (i.e. ink replenishment). Maintaining a positive pressure in the primary ink tanks T1 is advantageous in that it makes possible to feed the primary ink tanks with ink while a printing operation is under progress.

During a printing operation, the controller CT1 causes the primary pumps 52 to pump ink from the appropriate primary ink tank(s) T1 to the corresponding printhead(s) PT. Ink is then ejected by the printheads at the appropriate timing to form a desired image or pattern on the print medium MD.

Each secondary pump PM is to maintain a positive pressure in the corresponding primary ink tank T1 when the primary pump 52 are pumping ink from a primary ink tank T1 to the corresponding printhead PT.

Each secondary pump PM may include at least one of an eccentric diaphragm pump, a valve pump, a volumetric pump, a peristaltic pump, a gear pump and a centrifugal pump. The type and specifications of each secondary pump PM will be chosen appropriately by the skilled person depending on each case.

In a particular example, the controller CT1 is operable to actuate a secondary pump PM upon detection, by the associated pressure sensor 48, that the pressure in a corresponding primary tank T1 is lower (or no more) than a first threshold Pmin1. For instance, in response to a signal from a pressure sensor 48 indicating that the pressure in a primary ink tank T1 is below Pmin1, the controller CT1 commands the corresponding secondary pump PM so as to cause the refill of the appropriate primary ink tank T1.

In a variant, the controller CT1 is to cause pumping by a secondary pump PM in response to a specific command from a user.

The present printer is thus advantageous in that it allows supplying primary ink tanks with ink when desired, typically when the level of ink in the primary tanks is under a predefined level. The secondary ink tanks are preferably of large capacity to allow unattended printing for a long period of time.

The use of the ink supply module of the present disclosure allows a lower intervention frequency and reduced ink price.

The ink supply module can advantageously cooperate with the pressure sensors and/or the controller of a given inkjet printer to enable refill of the ink primary tanks.

In a particular example, the controller CT1 is to actuate at least one secondary pump PM irrespective of whether the printhead is in the processing of printing on said print medium.

As indicated earlier, in a particular example, the inkjet printer 30 also includes a counting unit 54 operable to count a number of ink droplets deposited by a printhead PT under control of the controller CT1 (i.e. by actuating a primary pump 52). In an example, a respective counting unit 54 is provided in printer 30 for each printhead PT.

The controller CT1 is operable to receive count information from each counting unit 54, the count information being indicative of the number of droplets fired by a particular printhead PT (e.g. from at least one of the nozzles of said printhead) since a predetermined time.

Based on the received count information, the controller CT1 is operable to determine the level of ink still remaining in a particular ink secondary tank T2. In a particular example, the controller CT1 takes into account predetermined data indicative of the total capacity of the primary ink tank T1 and the secondary ink tank T2 of interest.

In an example, the controller CT1 starts assessing the amount of ink consumed from a particular secondary ink tank T2 at an instant corresponding to a signal indicating that a new secondary ink tank T2 has been put into working position in the ink supply module 60.

Further, in a particular example, the pressure sensor 48 of at least one primary ink tank T1 is used to determine when the corresponding secondary ink tank T2 is running out of ink.

In a particular example, the action of pumping performed by a particular secondary pump PM under control of controller CT1 (and CT2) gives rise to a succession of peaks of pressure in the corresponding primary ink tank. These peaks of pressure result from the inherent alternative nature of the pumping of a secondary pump PM when pumping ink from a secondary ink tank T2 to a primary ink tank T1. The flow of ink pumped into the primary ink tank T2 is not continuous but alternative such that it shows rises and falls periodically, indicating that the pressure in the primary tank T1 reaches periodic maximums within the ink chamber of the primary tank T1.

In a particular example, at least one pressure sensor 48 is operable to sense a train of successive peaks of pressure in the at least one primary ink tank T1 during the feeding of ink from a primary ink tank T2 (i.e. during the replenishment of the primary ink tank T1). The train of successive peaks of pressure is induced by the action of pumping of the secondary pump PM during said feeding.

The controller can be to detect an end of the train of successive peaks of pressure during said feeding based on the changes of pressure in the primary ink tank T1 by the associated sensor pressure T1. This detected end indicates that said at least one secondary ink tank T2 corresponding to the primary ink tank T1 of interest is running out of ink. In an example, the end of a train of successive peaks of pressure is detected when the maximum of a peak becomes less (or no more) than a threshold Pmin2. Further details in this respect will be provided below in a particular example with reference to FIGS. 5 and 6.

The controller CT1 can generate a warning signal for the user of the inkjet printer 30 in response to the detection of the end of a train of peaks of pressure in a primary ink tank of interest. The warning signal generated can be displayed on a screen (not shown) of the printer 30 or transmitted to the computer system 34 by controller CT1.

Figure 4:
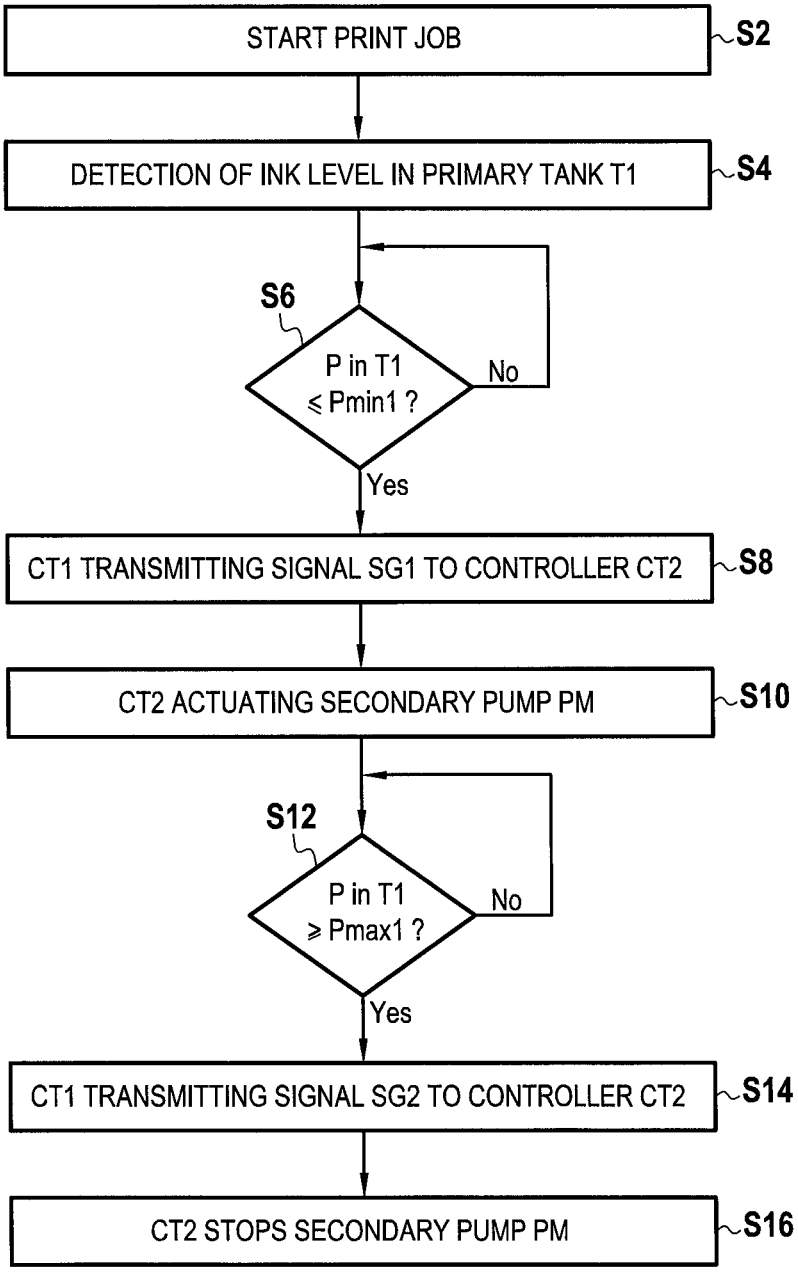
FIG. 4 is a flowchart showing a method of using an inkjet printer according to an example of the present disclosure.

A method carried out by the inkjet printer 30 as defined above is now described with reference to FIG. 4, according to a particular example.

In the present case, it is assumed that the ink supply module 60 is coupled to the inkjet printer 30 and that each secondary ink tank T2 is at a full level.

A print operation is started (S2), for instance upon command by the user by means of a user interface (not shown). The controller CT1 performs a print operation by causing deposition of ink on a print medium MD by the appropriate printheads PT at the appropriate timing. During the print operation S2, the controller CT1 causes the relative movements of the printheads PT and of the print medium MD by controlling the carriage unit 46 and the medium feeding unit 50, respectively.

Once the print operation is started, controller CT1 monitors (S4) the level of ink in at least one primary tank T1, based on the level of pressure transmitted by the corresponding pressure sensor 48.

It is now considered the case where controller CT1 monitors the level of ink in primary ink tank T14, for illustrative purpose only. It should be understood that the controller CT1 can monitor (S6) the pressure in at least one of the primary ink tanks T1.

As long as the pressure in primary ink tank T14 is detected to be greater than the threshold Pmin1, controller CT1 continues to monitor (S6) the level of ink in the primary tank T14, and this up to the end of the printing operation for instance.

If the controller CT1 detects (S6) that the pressure in the primary ink tank T14 becomes lower than or equal to the threshold Pmin1, it transmits (S8) a signal SG1 to controller CT2 indicating that replenishment of ink in primary ink tank T14 is needed.

In response to the received signal SG1, the controller CT2 actuates (S10) the appropriate secondary pump PM4 to cause the corresponding secondary ink tank T24 to feed (S10) the primary ink tank T14 with ink via the supply line SL4 connecting the primary ink tank T14 and the secondary ink tank T24.

Further, in a particular example, controller CT1 is also monitors (S12) the level of ink in the primary ink tank T14 during the operation S10 of ink replenishment.

As long as the pressure in the primary ink tank T14 as sensed by the pressure sensor 48 is below a threshold Pmax1, the feeding of ink from the secondary ink tank T24 is carried on.

If, based on the pressure information received from the pressure sensor 48, the controller CT1 detects (S14) that the pressure in the primary ink tank T14 is equal to or above the threshold Pmax1, the controller CT1 (S14) transmits a signal SG2 to the controller CT2 indicating that the replenishment of ink S10 in the primary ink tank T14 is completed.

In response to the signal SG2, the controller CT2 is to stop the secondary pump PM4, thereby ending pumping of ink from the secondary ink tank T24 to the primary ink tank T14.

Figure 5:
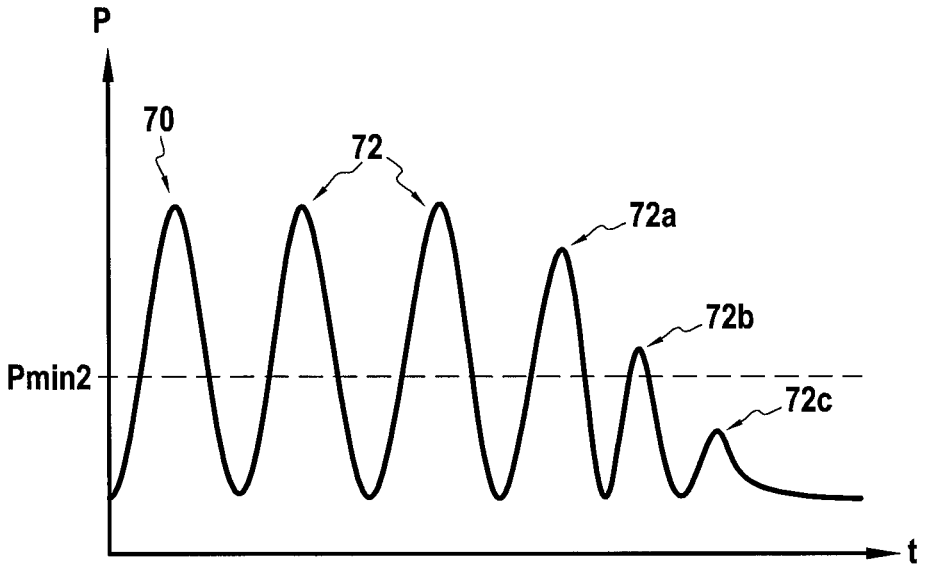
FIG. 5 represents schematically a curve representative of the pressure detected in a primary ink tank of an inkjet ink tank according to an example of the present disclosure.
Figure 6:
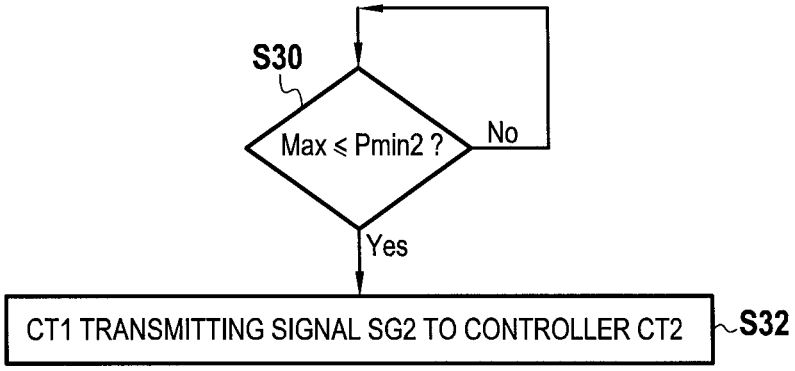
FIG. 6 is a flowchart showing a method according to an example of the present disclosure.

In a particular example shown in FIGS. 5 and 6, the controller CT1 is to determine, during the feeding S10 of ink to the primary ink tank T14, based on the pressure information transmitted by the pressure sensor 48, if the secondary ink tank T24 is running out of ink.

More particularly, while the secondary pump PM4 is pumping under the control of controller CT2, the controller CT1 receives information 70 from the pressure sensor 48 indicative of the current pressure in the primary ink tank T14. The controller is to monitor (S30) the train of successive peaks 72 of pressure detected by the pressure sensor 48 in the primary ink tank T14.

As long as the maximum of each peak of pressure is detected (S30) as being above the threshold Pmin2, the pumping of secondary pump PM4 carries on.

If the controller CT1 determines (S30), based on the pressure information 70, that the maximum of a peak of pressure becomes equal to or lower than the threshold Pmin2, it transmits (S32) the signal SG2 to the controller CT2 in the same manner as in S14 explained earlier (FIG. 4) so as to cause the end of pumping by the secondary pump PM4.

In the present example, the maximum of peaks 72*a* and 72*b* is detected to be higher than the threshold Pmin2. Upon detecting the maximum of peak 72*c* is lower than the threshold Pmin2, the controller CT1 instructs (S32) the controller CT2 to terminate pumping by secondary pump PM24.

This configuration is advantageous in that it allows detecting that a secondary ink tank of the ink supply module is running out of ink with great efficiency, by using pressure information from a pressure sensor of a corresponding primary ink tank. Detection of an end of the train of successive peaks of pressure in the primary ink tank of interest during replenishment indicates that the corresponding secondary ink tank is running out of ink and need replacement or refill.

The various computer programs mentioned earlier can be expressed in any programming language, and can be in the form of source code, object code, or any intermediary code between source code and object code, such that in a partially-compiled form, for instance, or in any other appropriate form.

In addition, the recording medium (i.e. the memory units) previously mentioned can be any entity or device capable of storing the computer program. For example, the recording medium can comprise a storing means, such as a ROM memory (a CD-ROM or a ROM implemented in a microelectronic circuit), or a magnetic storing means such as a floppy disk or a hard disk for instance.

Moreover, each recording medium previously mentioned can correspond to a transmittable medium, such as an electrical or an optical signal, which can be conveyed via an electric or an optic cable, or by radio or any other appropriate means. The computer program according to the invention can in particular be downloaded from the Internet or a network of the like.

As already explained, the present disclosure is not limited to the examples described above and should be understood as encompassing various alternatives and adaptations that the skilled person would contemplate within the scope of the present disclosure.

The invention claimed is:

1. An inkjet printer, comprising:

a carriage unit to which a printhead is coupleable;

a primary ink tank to store ink;

a secondary ink tank to store ink; and a controller to:

cause the primary ink tank to supply the printhead with ink for printing an image on a print medium; and actuate a pump provided on a supply line to cause the secondary ink tank to feed the primary ink tank with ink via the supply line when the controller receives a signal that an ink level in the primary tank is lower than a first threshold corresponding to peaks of pressure during feeding.

2. The inkjet printer according to claim 1, including a pressure sensor to sense pressure in the printhead, wherein the controller is to actuate the pump if the pressure sensor detects that the ink level in the primary tank is lower than the first threshold.

3. The inkjet printer according to claim 2, wherein the pressure sensor is to sense a train of successive peaks of pressure in the primary ink tank during the feeding, the train of successive peaks of pressure being induced by the action of pumping of the pump during the feeding, wherein the controller is to detect an end of the train of successive peaks of pressure during the feeding, the end indicating that the secondary ink tank is running out of ink.

4. The inkjet printer according to claim 1, wherein the pump is to pump by direct contact the ink from the secondary ink tank to the primary ink tank during the feeding.

5. The inkjet printer according to claim 1, wherein the pump is to maintain a positive pressure in the primary ink tank during the feeding of ink from the secondary ink tank.

6. The inkjet printer according to claim 1, including:

a medium moving unit to move the print medium along a printing-medium advance direction, wherein the carriage unit is to move along a traverse direction.

7. The inkjet printer according to claim 6, wherein the primary ink tank is positioned off the carriage in the inkjet printer.

8. The inkjet printer according to claim 1, including:

a counting unit to count the number of ink droplets fired by the printhead, wherein the controller is to assess a current level of ink in the secondary ink tank based on the number of ink droplets counted by the counting unit.

9. The inkjet printer according to claim 8, wherein the controller is to generate a signal for warning a user of the inkjet printer when the assessed current level of ink is below a second threshold.

10. The An inkjet printer according to claim 1, wherein the printhead is coupled to the carriage unit and the controller is to actuate the pump irrespective of whether the printhead is in the processing of printing on the print medium.

11. A printer:

a primary ink tank for storing ink to supply a printhead with the stored ink for printing on a print medium;

a secondary ink tank for storing ink;

a pressure sensor to sense pressure in the primary ink tank; and a controller to:

detect a train of successive peaks of pressure during feeding based on changes of pressure in the primary ink tank; and actuate a pump to cause pumping by direct contact of the ink from the secondary ink tank to the primary ink tank when the end of the train of successive peaks of pressure in the primary ink tank is lower than a first threshold corresponding to the train successive peaks of pressure during feeding.

12. A method carried out by printer to print an image on a print medium, the printer including a carriage unit to which a printhead can be coupled, a primary ink tank for storing ink, a secondary ink tank for storing ink, a pump provided on a supply line, and a controller, the method comprising:

determining a level of ink of the secondary ink tank by using pressure information from a pressure sensor of the primary ink tank; and actuating, by the controller, the pump to cause the secondary ink tank to feed the primary ink tank with ink via the supply line when based on a peak detected by the pressure sensor of the primary ink tank, the level of ink of the secondary ink tank indicates the secondary ink tank is running out of ink.

13. The method according to claim 12, wherein the printer includes a pressure sensor to sense the pressure in the printhead when the printhead is positioned on the carriage unit, the method including:

monitoring the level of ink of the primary ink tank; and detecting that the ink level in the primary ink tank is lower than a first threshold corresponding to a train of successive peaks of pressure, wherein the actuating of the pump is carried out by the controller upon the detection.

14. A computer program including instructions for carrying out the method of claim 12 when the computer program is executed by a controller.

15. A non-transitory computer recording medium readable by a computer, the recording medium storing a computer program including instructions for carrying out the printing method of claim 12.

* * * * *